United States Patent [19]

Nnadi et al.

[11] 4,086,173

[45] Apr. 25, 1978

[54] LUBRICANT COMPOSITIONS CONTAINING MULTIFUNCTIONAL ADDITIVES

[75] Inventors: John C. Nnadi, Glassboro; Margaret H. McIntyre, West Deptford, both of N.J.

[73] Assignee: Mobil Oil Corporation, New York, N.Y.

[21] Appl. No.: 584,241

[22] Filed: Jun. 5, 1975

[51] Int. Cl.[2] ..... C10M 1/32

[52] U.S. Cl. ..... 252/51.5 A

[58] Field of Search ..... 252/56 R, 51.5 A, 390, 252/392; 260/326.5 B, 485 G, 307 F

[56] References Cited

U.S. PATENT DOCUMENTS

| | | | |
|---|---|---|---|
| 3,172,892 | 3/1965 | Le Suer et al. | 252/51.5 A |
| 3,219,666 | 11/1965 | Norman et al. | 252/51.5 A |

*Primary Examiner*—Daniel E. Wyman

*Assistant Examiner*—Mrs. Y. Harris-Smith

*Attorney, Agent, or Firm*—Charles A. Huggett; Raymond W. Barclay; Thomas S. Szatkowski

[57] ABSTRACT

Lubricant compositions containing a dispersancy improving and antirust amount of the product obtained by reacting an alkenylsuccinic anhydride having from about 20 to about 500 carbon atoms with a member of the group consisting of: (A) an alkylene polyamine having the structure $$H_2N—(C_nH_{2n}NH)_x—C_nH_{2n}—NH_2$$

in which $n$ is a whole number from 2 to 4, $x$ is a whole number from 1 to 10, said anhydride being present in an amount sufficient to react with all amino groups in the alkylene polyamine; (B) a mono or a bis-alkenylsuccinimide of an alkylene polyamine; and (C) a glycol ester, aminoglycol ester, imidoester, amidoester or oxazoline ester of an alkenylsuccinic anhydride.

16 Claims, No Drawings

LUBRICANT COMPOSITIONS CONTAINING MULTIFUNCTIONAL ADDITIVES

BACKGROUND OF THE INVENTION

1. Field of the Invention

This relates to lubricant compositions and, in one of its aspects, relates more particularly to lubricant compositions having improved dispersancy and antirust properties in performing their functions. Still more particularly, in this aspect, the invention relates to lubricant compositions in the form of lubricating oils and grease containing additives effective for improving dispersancy and antirust properties.

2. Description of the Prior Art

Prior to the present invention, commercially available alkenylsuccinimides functioning as dispersants have been incorporated into lubricant compositions. In preparing these alkenylsuccinimides dispersants, polybutenylsuccinic anhydrides are employed. The resulting product is of relatively low molecular weight, non-acidic, and effective as a dispersant only at relatively low temperature. In this respect, pertinent prior art discloses the reaction of internal amino groups with succinic anhydride, as in U.S. Pat. No. 3,445,386 of reaction between succinic anhydride and polyamines as in U.S. Pat. No. 3,172,892. These references, however, do not suggest a specific dispersancy and antirust improvement obtained from the use of the products of the present invention, in lubricating compositions. Also, high molecular weight succinimides and amides are disclosed as the art as dispersants for example in U.S. Pat. No. 3,219,666. But these have poor high temperature and antirust properties and also are lower in molecular weight than the products of the present invention.

SUMMARY OF THE INVENTION

It has now been found that certain multifunctional additives may be incorporated in lubricant compositions for imparting improved dispersancy and antirust properties employing polybutenylsuccinic, anhydrides, for preparing alkenylsuccinimide dispersants and antirust improvers, in an amount two or more times greater than those conventionally employed for making alkenylsuccinimide dispersants. These products are obtained by reacting an alkenylsuccinic anhydride having from about 20 to about 500 carbon atoms in the alkenyl group with a member of the group consisting of: (A) an alkylene polyamine having from about 2 to about 10 carbon atoms in the alkylene group and having the structure $H_2N—(C_nH_{2n}NH)_x—C_nH_{2n}—NH_2$ in which $n$ is a whole number from 2 to 4, $x$ is a whole number from 1 to 10, said anhydride being present in an amount sufficient to react with all amino groups in the alkylene polyamine; (B) a mono or a bis-alkenylsuccinimide of an alkylene polyamine having from up to 500 carbon atoms in the alkylene group; and (C) a glycol ester, aminoglycol ester, imidoester, amidoester or oxazoline ester of an alkenylsuccinic anhydride having from about 20 to about 500 carbon atoms in the alkylene group.

The above-described reaction product, unlike that of the aforementioned prior art is acidic in nature and of significantly higher molecular weight than that encountered with commercially available succinimide dispersants. Quite unexpected is the fact that despite the acidity of the reaction products of the present invention, these products have significantly improved high temperature dispersancy properties than, for example, bis-succinimide reaction products of polybutenylsuccinic anhydrides and tetraethylenepentamine.

The aforementioned reaction products may be incorporated in any lubricating media which may comprise liquid hydrocarbon oils in the form of either a mineral oil or a synthetic oil, or in the form of a grease in which any of the aforementioned oils are employed as a vehicle. In general, mineral oils employed as the lubricant, or grease vehicle, may be of any suitable lubricating viscosity range, as, for example, from about 45 SSU at 100° F to about 6000 SSU at 100° F, and, preferably from about 50 to about 250 SSU at 210° F.

These oils may have viscosity indexes varying from below zero to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

In instances where synthetic oils, or synthetic oils employed as the vehicle for the grease, are desired in preference to mineral oils or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl) adipate, dibutyl phthalate, fluorocarbons, silicate esters, silanes, esters of phosphorous-containing acids, liquid ureas, ferrocent derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, phenoxy phenylether, etc.

In preparing the dispersancy improving and antirust product of the present invention, reaction between the aforementioned alkenylsuccinic anhydride and a member of the group consisting of (A), (B) or (C) is conducted, generally, at a temperature from about 30° C to about 250° C, and, preferably, from about 80° C to about 200° C. The aforementioned reaction product may, for many purposes, be incorporated in the lubricant, in an amount from about 0.001% to about 10%, by weight, and preferably in an amount from about 0.5% to about 5% by weight. The alkenylsuccinic anhydride is preferably reacted with a member of the aforementioned group consisting of (A), (B) and (C) in a mole ratio of 1:1 to about 4:1 or more depending on the number of —NH and —OH groups in (A), (B) and (C).

DESCRIPTION OF SPECIFIC EMBODIMENTS

The following examples and comparative data will serve to illustrate the novel dispersancy improving and antirust products of the present invention, the method for their preparation and their utility in lubricating media, particularly for the aforementioned dispersancy and antirust improvement.

In general, the reaction products employed in the lubricant compositions of the present invention are reaction products of amine based ashless dispersants such as succinimides, lactams, pyrrolidines, mannich bases and oxazolines with alkyl or alkenylsuccinic anhydrides. It has been found that these products are superior as high temperature dispersants and antirust agents than the parent dispersants. It is also been found, in accordance with the present invention, that the reaction between the performed bis-succinimide and alkenylsuccinic anhydrides results in superior products over one-step procedures in which excess alkenylsuccinic anhydride is reacted with a polyethyleneamine. Products prepared from polyalkenylsuccinic anhydrides are found to perform better than those made from maleic anhydride, as in the prior art. Products of the prior art, in this regard, are basic (such as those disclosed in U.S. Pat. No. 3,219,666) and exhibit inferior rust protection properties, unlike the products of the present invention which are acidic in nature. It should also be noted that the succinimides of the present invention may be reduced to lactam or pyrrolidine before reaction with the anhydride. The succinimide may also be crosslinked with pyrimidine, triazine or pyridine rings prior to reaction with the anhydride. The molar ratios of the amine dispersants to the anhydrides can vary, in order to react some or all the —NH— and —OH groups of the dispersants depending on the degree of acidity desired for the product.

EXAMPLE 1

170 g. 61% active bis-succinimide (made from polybutenyl succinic anhydride mol. wt. 1000 and tetraethylene pentamine) 130 g. 56% active polybutenyl succinic anhydride (mol. wt. 1450) and 60 g. process oil were heated to and kept at 170° C for 4 hours and at the same temperature under house vacuum for ½ hour. The yield of filtered product was quantitative. Found: % N 0.91; % Basic N 0.30; Acid # (ASTM D664-5) 4.16. The above represents the case of a 1:1 molar ratio of succinimide to succinic anhydride.

EXAMPLE 2

The procedure of Example 1 was repeated except that the molar ratio of the succinimide to the anhydride was 1:2. The yield of filtered product was quantitative. Found: % N 0.65; % BAsic N 0.14; Acid # 8.3.

EXAMPLE 3

The procedure of Example 1 was repeated except that the molar ratio of the succinimide: to the anhydride was 1:3. Found % N 0.50; % Basic N 0.11; Acid # 12.4.

EXAMPLE 4

The procedure of Example 2 was repeated except that the alkenyl group of the succinic anhydride had a mol. wt. of 2000. Found: % N 0.45%, % Basic N 0.08; Acid # 6.3.

EXAMPLE 5

The procedure of Example 1 was repeated except that

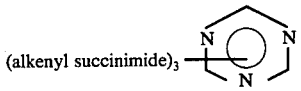

was used in place of the succinimide. The molar ratio of the triazine crosslinked succinimide to the polybutenylsuccinic anhydride (polybutene, mol. wt. 1350) was 1:1. Found: % N 0.49, % Basic N 0.20; Acid # 4.9.

EXAMPLE 6

The procedure of Example 5 was repeated except that the molar ratio of the crosslinked succinimide to the succinic anhydride (from polybutene mol. wt. 2000) was 1:1. Found: % N 0.43; % Basic N 0.18; Acid # 2.7.

EXAMPLE 7

The procedure of Example 1 was repeated except that the appropriate amount of maleic anhydride was used in place of alkenyl succinic anhydride. The yield of filtered product was quantitative. Found: % N 1.57; % Basic N 0.42; Acid # 9.8.

EXAMPLE 8

The procedure of Example 2 was repeated except that the appropriate amount of maleic anhydride was used in place of alkenyl succinic anhydride. Found: % N 1.55; % Basic N 0.42; Acid # 12.7.

EXAMPLE 9

An oxazoline diester [made by reacting alkenyl succinic anhydride (polybutene mol. wt. 1350) with $NH_2C(CH_2OH)_3$] was reacted with the above anhydride in a 1:2 molar ratio as described in Example 1. A quantitative yield of product was obtained.

EXAMPLE 10

An alkenyl pyrrolidine made by reducing all the —C=O of the succinimide of Example 1 and alkenyl succinic anhydride (polybutene 1350 mol. wt.) were reacted in a 1:2 molar ratio as described in Example 1. The yield of product was quantitative.

EXAMPLE 11

A lactam amide,

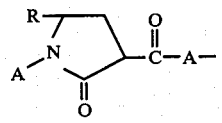

(R = polybutene molecular weight 1350, A = tetraethylene pentamine) was reacted with alkenyl succinic anhydride (polybutene molecular weight 1350) in a 1:4 molar ratio. The yield of product was quantitative.

EXAMPLE 12

7 g. bis alkenylsuccinimide (made from tetrapropenylsuccinic anhydride and tetraethylene pentamine), 250 g. polybutenylsuccinic anhydride (the alkenyl group having a molecular weight of 2000) and 50 g. process oil were reacted as in Example 1 to obtain a quantitative yield of product. This example employs a molar ratio of 3:1 of anhydride to bis succinimide and illustrates the case where the alkenyl group of the bis succinimide is both propylene derived and low molecular weight.

EXAMPLE 13

From 7 g. bis succinimide of Example 12 130 g. alkenylsuccinic anhydride (the alkenyl group having a molecular weight of 1350) and 20 g. process oil, reacted as in Example 12, quantitative yield of product was obtained.

The dispersancy improving and antirust products of the present invention were subjected to a series of tests to evaluate their utility in lubricating oils. In the following humidity chamber rust test* the base oil employed was a 150 SSU at 210° F base stock lubricating oil. To this oil are added 2%, by weight, of the products of the present invention, and the days required to show rust were recorded.

*This is a general purpose and rather severe test. It utilizes a humidity chamber operated at 120° F and 97–98% Relative Humidity with an air circulation rate of 150 cubic feet per minute.

The test panels are 2 × 4 × ⅛inch polished steel plates of SAE 1010 steel of a 10 micron finish.

The test is performed by first cleaning a new panel in naptha, absolute methanol and xylene in that order. The air dried panel is then dipped in a test formulation for 1 minute and then "drip-dried" for 2 hours prior to insertion into the chamber. The panels are suspended in a vertical position within the chamber and can be continuously monitored through the glass dome of the chamber.

The severity of the test can be judged by the rapid rusting rate (1 hour) of a Panel coated only with a base stock compared to complete rust inhibition for periods up to 7 days when utilizing an effective rust inhibitor in concentrations of 0.5 to 4.0%.

TABLE I

RUST TEST IN HUMIDITY CHAMBER

| Ex. | | Days to Show Rust |
|---|---|---|
| 14 | Base Oil | <1 |
| 15 | Base Oil + 2% Succinimide of Ex. 1 | 1 |
| 16 | Base Oil + 2% Product of Ex. 2 | 4 |
| 17 | Base Oil + 2% Product of Ex. 3 | >7 |
| 18 | Base Oil + 2% Product of Ex. 4 | >7 |
| 19 | Bae Oil + 2% Product of Ex. 12 | >7 |
| 20 | Base Oil + 2% Product of Ex. 13 | >7 |

As will be apparent from the foregoing Table I, the presence of the products of the present invention in the base oil results in a longer period of time for rust to occur (examples 16, 17, 18, 19 and 20) than those for the base oil containing only the succinimide of Example 1 (Example 15) or the base oil alone (Example 14).

As shown in the following Table II, the aforementioned base oil of Table I, containing 2%, by weight, of only the succinimide of Example 3, was compared with the same base oil containing 2%, by weight, of the product of Example 3 (Example 17). In this evaluation, rust ratings were compared employing the Standard Olds IIC Engine Test, described in ASTM publication STP 315F.

TABLE II

OLDS IIC ENGINE TEST

| Example | | Rust Rating (Spec. 8.4) |
|---|---|---|
| 21 | Base Oil + 2% Succinimide of Ex. 3 | 7.4 (Fail) |
| 22 | Base Oil + 2% Product of Ex. 3 | 8.5 (Pass) |

As will be seen with a standard acceptable rust rating of at least 8.4, the base oil of Example 17, containing 2%, by weight, of the product of Example 3, passed the test with a rating of 8.5; while the same base oil containing 2%, by weight, of only the succinimide of Example 3 (Example 21) failed this test with a rating of 7.4.

Another series of evaluations relative to piston cleanliness was conducted employing the Standard Caterpillar 1-G Engine Test (Federal Test Method 341.3) with the results shown in the following Table III.

TABLE III

CATERPILLAR 1-G ENGINE TEST

| Ex. | | Results at 240 hrs. Overall Piston Rating 100 = Clean |
|---|---|---|
| 23 | Base Oil | <34 |
| 24 | Base Oil + 2% Product Ex. 3 | 83 |
| 25 | Base Oil + 2% Product Ex. 4 | 89 |
| 26 | Base Oil + 2% Succinimide of Ex. 3 | 47 |

As will be apparent from Table III, with an overall piston rating of 100, indicating a clean condition, the aforementioned base oil of Tables I and II, exhibited a rating of <34 at 240 hours test (Example 23); while the same base oil containing 2%, by weight, of the products of Examples 3 and 4 (Examples 24 and 25 respectively) exhibited a rating of 83 and 89 respectively. The same base oil containing the succinimide of Example 3 only exhibited a rating of 47 (Example 26).

While this invention has been described with reference to preferred compositions and components therefor it will be understood, by those skilled in the art, that departure from preferred embodiments can be effectively made and are within the scope of the specification.

We claim:

1. A lubricant composition containing a dispersancy improving and antirust amount of the acidic product obtained by reacting an alkenylsuccinic anhydride having from about 20 to about 500 carbon atoms in the alkenyl group with a member of the group consisting of (1) a bis-alkenyl succinimide, having up to 500 carbon atoms in the alkylene group, of an alkylene polyamide and (2) a glycol ester, amino glycol ester, imidoester, amidoester or oxazoline ester of an alkenylsuccinic anhydride having from about 20 to about 500 carbon atoms in the alkylene group.

2. A lubricant composition as defined in claim 1 wherein said acidic dispersancy improvement and antirust product is present in an amount from about 0.001% to about 10% by weight.

3. A lubricant composition as defined in claim 1 wherein said acidic dispersancy improvement and antirust product is present in an amount from about 0.5% to about 5% by weight.

4. A lubricant composition as defined in claim 1 wherein said lubricant comprises an oil of lubricating viscosity.

5. A lubricant composition as defined in claim 1 in which said acidic dispersancy improvement and antirust product is obtained by reacting a crosslinked alkenylsuccinimide having the structure

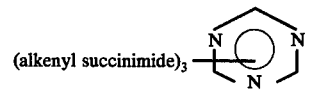

with a polybutenylsuccinic anhydride.

6. A lubricant composition as defined in claim 1 in which said acidic dispersancy improvement and antirust product is bis-succinimide obtained by reacting an oxazoline diester with a polybutenylsuccinic anhydride, said oxazoline diester having been prepared by reacting an alkenylsuccinic anhydride with a compound having the structure $NH_2C(CH_2OH)_3$.

7. The acidic reaction product obtained by reacting an alkenysuccinic anhydride having from about 20 to about 500 carbon atoms in the alkenyl group with a member of the group consisting of: (1) a bis-alkenyl succinimide, having up to 500 carbon atoms in the alkylene group, of an alkylene polyamine and (2) a glycol ester, amino glycol ester, imidoester, amidoester or oxazoline ester of an alkenylsuccinic anhydride having from about 20 to about 500 carbon atoms in the alkylene group.

8. A reaction product as defined in claim 1 wherein said reaction is carried out at a temperature from about 30° C to about 250° C.

9. A reaction product as defined in claim 1 wherein said reaction is carried out at a temperature from about 80° C to about 200° C.

10. A reaction product as defined in claim 1 wherein said product is obtained by reacting a crosslinked alkenylsuccinimide having the structure

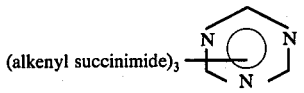

with polybutenylsuccinic anhydride.

11. A reaction product was defined in claim 1 wherein said product is obtained by reacting an oxazoline diester with a polybutenylsuccinic anhydride, said oxazoline diester having been prepared by reacting an alkenylsuccinic anhydride with a compound having the structure $NH_2C(CH_2OH)_3$.

12. A lubricant composition as defined in claim 1 wherein the alkenyl succinic anhydride is reacted with a member of the (1) and (2) groups in a mole ratio of 1:1 to about 4:1.

13. A reaction product as defined in claim 7 wherein the alkenyl succinic anhydride is reacted with a member of the (1) and (2) groups in a mole ratio of 1:1 to about 4:1.

14. A lubricant composition in accordance with claim 1 containing a dispersancy improving and antirust amount of the acidic product obtained by reacting an alkenyl succinic anhydride having from about 20 to about 500 carbon atoms in the alkenyl group with a member of the group consisting of: (1) bis-alkenyl succinimide, having up to 500 carbon atoms in the alkylene group, of an alkylene polyamine having the structure $H_2N—(C_nH_{2n}NH)_x—C_nH_{2n}—NH_2$ in which $n$ is a whole number from 2 to 4, $x$ is a whole number from 1 to 10; and (2) a glycol ester, amino glycol ester, imidoester, amidoester or oxazoline ester of an alkenyl succinic anhydride having from about 20 to about 500 carbon atoms in the alkylene group.

15. A reaction product is accordance with claim 7 obtained by reacting an alkenyl succinic anhydride having from about 20 to about 500 carbon atoms in the alkenyl group with a member of the group consisting of: (1) bis-alkenyl succinimide, having up to 500 carbon atoms in the alkylene group, of an alkylene polyamine having the structure $H_2N—(C_nH_{2n}NH)_x—C_nH_{2n}—NH_2$ in which $n$ is a whole number from 2 to 4, $x$ is a whole number from 1 to 10; and (2) a glycol ester, amino glycol ester, imidoester, amidoester or oxazoline ester, of an alkenyl succinic anhydride having from about 20 to about 500 carbon atoms in the alkylene group.

16. A lubricant composition in accordance with claim 1 containing a dispersancy improving and antirust amount of the acidic product obtained by reacting an alkenyl succinic anhydride having from about 20 to about 500 carbon atoms in the alkenyl group with a member of the group consisting of: a glycol ester, amino glycol ester, imidoester, amidoester, or oxazoline ester of an alkenyl succinic anhydride having from about 20 to about 500 carbon atoms in the alkylene group.

* * * * *

UNITED STATES PATENT AND TRADEMARK OFFICE

CERTIFICATE OF CORRECTION

PATENT NO. : 4,086,173

DATED : April 25, 1978

INVENTOR(S) : JOHN C. NNADI and MARGARET H. McINTYRE

It is certified that error appears in the above-identified patent and that said Letters Patent are hereby corrected as shown below:

Column 1, line 25, "3,445,386 of" should read --3,445,386 or--.

Column 1, line 32, "disclosed as" should read --disclosed in--.

Column 6, line 34, "of an alkylene polyamide" should read --of an alkylene polyamine--.

Column 7, line 27, "product was defined" should read --product as defined--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*